United States Patent [19]

Winters

[11] 4,246,723

[45] Jan. 27, 1981

[54] COLOR CHANGEABLE EYES DEVICE FOR MANIKIN HEADS

[76] Inventor: William M. Winters, 315 Cora Ave., Lawrenceburg, Ind. 47025

[21] Appl. No.: 95,924

[22] Filed: Nov. 19, 1979

[51] Int. Cl.[3] ..... A63H 3/38

[52] U.S. Cl. ..... 46/135 R; 46/172; 223/66

[58] Field of Search ..... 46/135 R, 153, 172; 223/66, 68

[56] References Cited

U.S. PATENT DOCUMENTS

| | | | |
|---|---|---|---|
| 1,821,243 | 9/1931 | Springer | 46/135 R |
| 2,073,869 | 3/1937 | Jacoby | 46/172 UX |
| 3,757,465 | 9/1973 | Barlow | 46/135 R |

FOREIGN PATENT DOCUMENTS

| | | | |
|---|---|---|---|
| 267845 | 9/1929 | Italy | 46/135 R |

*Primary Examiner*—F. Barry Shay

*Attorney, Agent, or Firm*—Walter S. Murray

[57] ABSTRACT

The invention concerns a device for selectively changing the colors of the irises for the eyes of store manikins to coordinate the iris colors with the decor of the garniture to be displayed on the manikin and with the color of the hair piece to be placed on the manikin's head. The device has a releasable means to hold pairs of irises in selected position in the eye openings of the head comprising a manually operable toothed wheel having its teeth engaged by the interior surface of the hair piece that is to be finally placed on the head of the manikin.

1 Claim, 5 Drawing Figures

Figure 5:
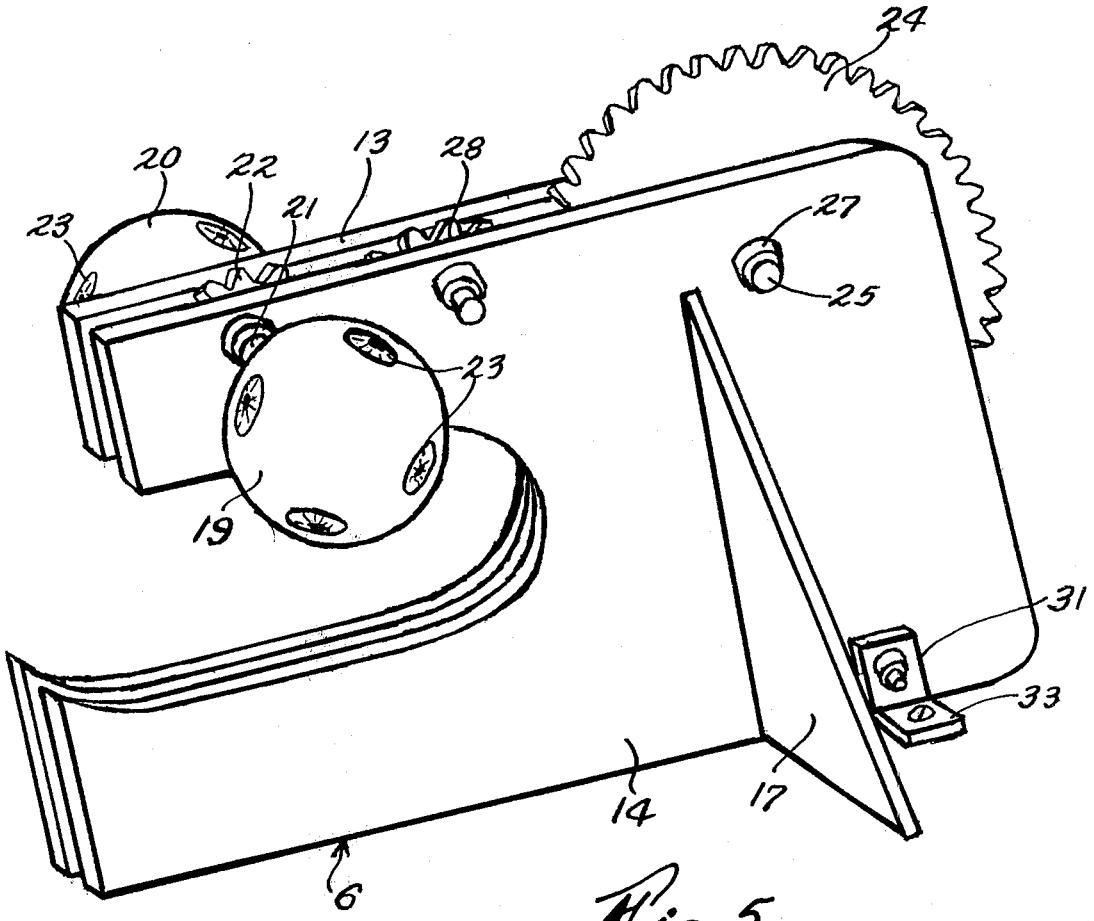

Fig. 1
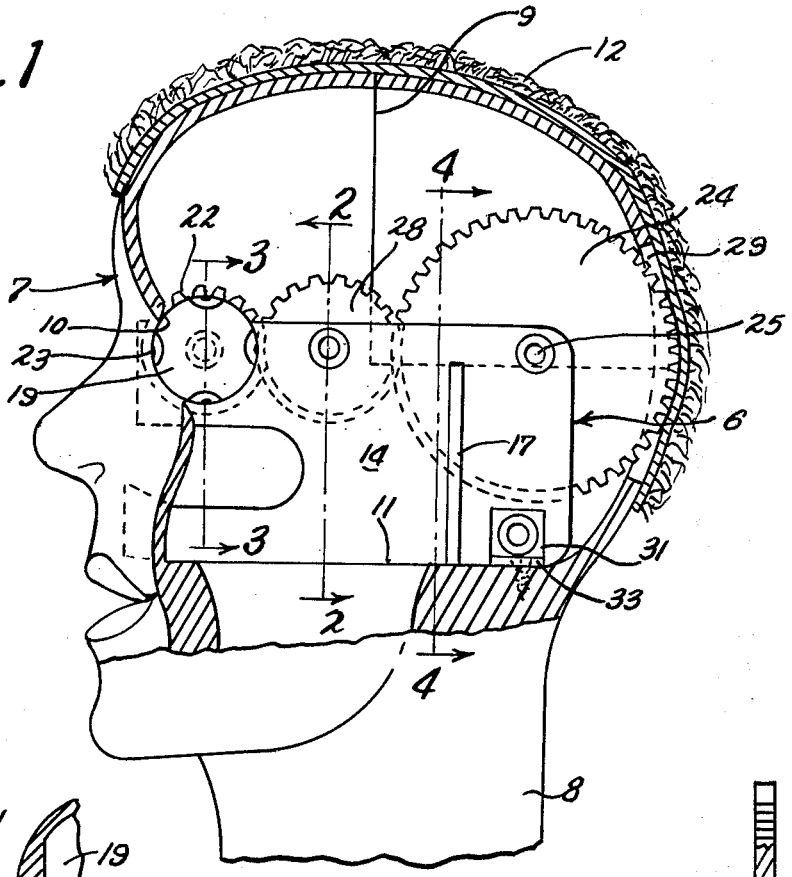
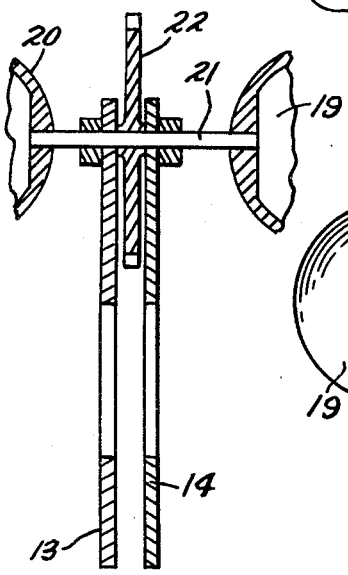
Fig. 3
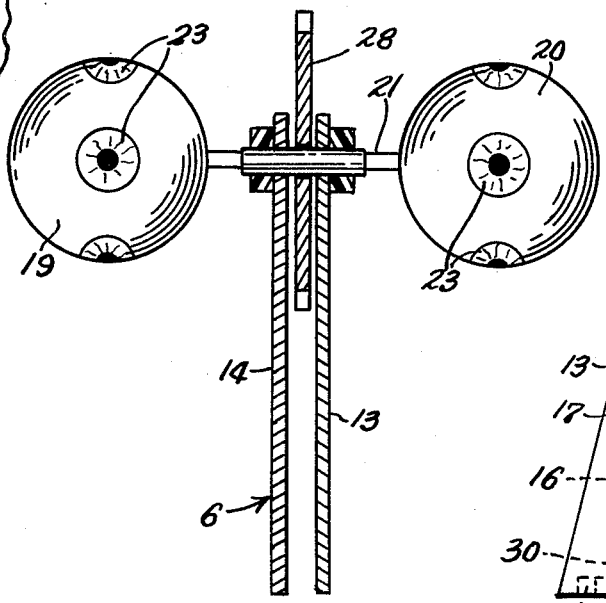
Fig. 2
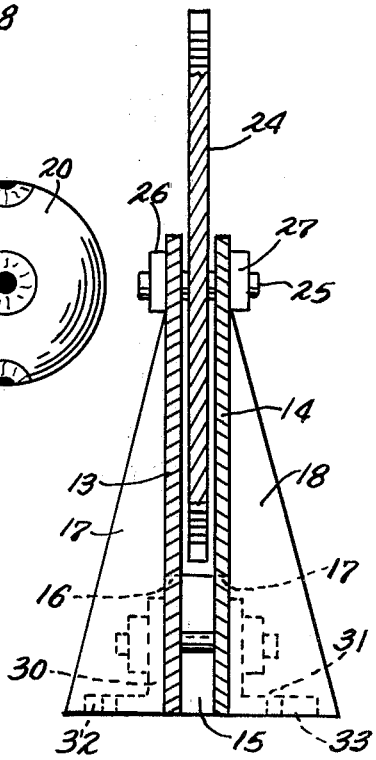
Fig. 4

COLOR CHANGEABLE EYES DEVICE FOR MANIKIN HEADS

This invention relates to store display manikins and is particularly directed to a color changeable eyes device for the heads of such figures.

An object of the invention is to provide a color changeable eyes device for the heads of store manikins that are adapted to display merchandise such as suits, dresses of hair pieces, said device being wholly disposed within the hollow heads of the manikins and affording manual iris adjustment means externally of the head, said means being concealed by the specific hair piece adapted to carry out the selected decor for the display.

Another object of the invention is to provide a changeable eyes device which has an adjustment means external of the manikin head which when manually operated exposes to view different colored irises through the eye openings of the head, said means being held in adjusted position and also concealed from view by a hair piece or wig subsequently applied to the manikin head.

A further object of the invention is to provide a relatively simplified color changeable eyes device susceptible of incorporation into the hollow heads of existing or manufactured manikin heads and which will serve to coordinate the color of the manikin's eyes with the decor of the garniture to be displayed on the manikin and with the color of the hair piece to be finally placed on the manikin's head.

Other features and advantages of my invention will become apparent from the following specification taken in conjunction with the accompanying drawings, wherein:

FIG. 1 is a sectional view taken through a representative head of a store manikin, the color changeable eyes device being positioned therein and shown in side elevation.

FIGS. 2, 3 and 4 are enlarged sections taken on lines 2—2, 3—3, and 4—4, respectively, of FIG. 1.

FIG. 5 is an enlarged perspective view of my color changeable eyes device.

With particular reference to FIGS. 1 and 5 of the drawings this invention is directed to a color changeable eyes device 6 for incorporation into the hollow heads 7 of manikins 8, such manikins being either in the form of plaster busts or complete models of the human body, (not shown). The back part of the head 7 may be quartered on a cut and reseal line 9 for entrance of the device 6 thereinto and is also provided with a pair of eye openings 10. The head usually has a shelf 11, or the like, molded within the interior base of the head. These heads are covered with wigs or hair pieces 12 to simulate the human head and have usually been produced in blond, brunette and red hair to complement the selected decor of the merchandise to be displayed on the store manikin.

My color changeable eyes device 6 consists of two identical and closely spaced apart plates 13 and 14 preferably of plastic material that are secured together by a foreshortened cross plate 15 (FIG. 4) which fits into notches 16 and 17 in the plates 13 and 14, respectively, said cross plate being integral with gussets 17—17 extending at right angles from contacts with the plates 13 and 14, respectively. The plates are disposed within the manikin head in an upstanding position upon the shelf 11 and located thereon between the eye openings 10.

A pair of eye balls 19 and 20 are fixed on opposite ends of a cross shaft 21 that is in turn journaled at its central portion in the plates 13 and 14, a toothed wheel 22 being fixed to the cross shaft 21 and located between the plates 13 and 14. As best shown in FIGS. 1 and 2 each eye ball 19 and 20 has a number of irises 23 arcuately spaced apart on a great circle of the eye ball, each pair of irises presenting a different color, such as shades of blue, brown, green and gray.

A relatively large manually operated toothed wheel 24 is journaled between the plates 13 and 14 and with particular reference to FIG. 4 of the drawings the journal means comprises a cross shaft 25 extending through both plates and engaged at each of its ends by a press fitted plastic collar 26 and 27 and when coated over with a liquid plastic, which when set, firmly holds the parts in position. The toothed wheel 24 is operatively connected to the toothed wheel 22 by an idler wheel 28 journaled between the plates 13 and 14.

As shown in FIG. 1, the manikin head 7 has an upstanding slot 29 formed through a back part thereof in alignment with the upstanding plates 13 and 14, a small portion of the toothed wheel 24 being adapted to project through the slot 29 to provide a manually accessable operating means for actuating the wheel train of the device which in turn rotates the eye balls 19 and 20 to change the colors of the irises to conform to the desired decor of the selected and modeled merchandise to be placed on the manikin. After the irises have been adjusted to the desired color, the hair piece 12 is placed on the manikin head to cover and effectively conceal the color changeable eyes device and its operating wheel from view. With reference to FIG. 1 of the drawings it will be noted that the large toothed wheel 24 meshes with a relatively small idler wheel 28 thus reducing the turning ratio of the train and hence a greater resistance to rotation by the manually operated large toothed wheel 24. Also after the wig 12 has been placed on the manikin head the underside of the wig engages with the teeth of the large wheel 24 whereby a releasable means is provided to selectively hold the wheel train in adjusted iris positions. The device is mounted within the head by means of brackets 30 and 31 secured to the plates and having ears 32 and 33, respectively, screwed to the material of the head.

What is claimed is:

1. In combination with the hollow head of a store manikin having a pair of eye openings and a removable hair piece covering the head; a slot formed through the back of the head in an area covered by the hair piece, a color changeable eyes device consisting of a pair of spaced, upstanding plates adapted to be mounted within the head between the eye openings and in alignment with the slot in the head, a manually operable toothed wheel journaled between the plates and having a portion thereof projecting through the slot, a cross shaft journaled in the plates, a pair of eye balls mounted on opposite ends of the cross shaft, a series of differently colored irises arcuately spaced apart on great circles of the eye balls aligned in pairs and each pair of irises selectively visible through the eye openings in the head, a toothed wheel journaled between the plates connected to the pair of eye balls, releasable means for holding said pairs of irises in selected positions in the eye openings of the head, said releasable means comprising the hair piece which, when in position, engages the teeth of the manually operable toothed wheel, and an idler wheel journaled between the plates and operatively connecting the manually operable toothed wheel to the toothed wheel connected to the pair of eye balls, whereby, when the decor of the merchandise to be modeled by the manikin is changed, the color of the irises may be changed to complement said decor.

* * * * *